US005490304A

United States Patent [19]

Winner, Jr. et al.

[11] Patent Number: 5,490,304

[45] Date of Patent: Feb. 13, 1996

[54] FLOOR MOUNTED DOORSTOP

[75] Inventors: James E. Winner, Jr., Hollywood Beach, Fla.; L. David Carlo, Litchfield, Ohio

[73] Assignee: Winner International Royalty Corporation, Sharon, Pa.

[21] Appl. No.: 223,239

[22] Filed: Apr. 5, 1994

[51] Int. Cl.[6] ..... E05F 5/02

[52] U.S. Cl. ..... 16/82; 292/DIG. 15

[58] Field of Search ..... 16/82, 85; 292/DIG. 15, 292/341.12, DIG. 46, 296, 297, 298, 238

[56] References Cited

U.S. PATENT DOCUMENTS

| | | | |
|---|---|---|---|
| 1,082,432 | 12/1913 | Mertsheimer . | |
| 3,554,592 | 1/1971 | Kate . | |
| 3,661,413 | 5/1972 | Silva | 292/238 |
| 3,805,322 | 4/1974 | Serrano | 16/82 |
| 4,178,026 | 12/1979 | Sinkhorn . | |
| 4,705,309 | 11/1987 | Sawchuk | 16/82 |
| 4,797,970 | 1/1989 | Charlton | 292/DIG. 15 |
| 5,120,093 | 6/1992 | Carney | 16/82 |
| 5,383,254 | 6/1995 | Wigley, Sr. | 16/82 |

FOREIGN PATENT DOCUMENTS

| | | |
|---|---|---|
| 1909561 | 11/1969 | Germany . |
| 2620081 | 11/1977 | Germany . |

*Primary Examiner*—P. Austin Bradley
*Assistant Examiner*—Chuck Y. Mah
*Attorney, Agent, or Firm*—Vickers, Daniels & Young

[57] ABSTRACT

An improved doorstop provides increased safety along with simplified operation over previous doorstops. The doorstop is adapted to be received in a floor mounted receptacle in close proximity to the door. The device includes a door contact member which pivots from a first position in contact with a fully closed door to a second position which permits the door to be opened a limited but finite distance. There is no need to remove the device from the floor receptacle to permit limited movement of the door, thus affording increased protection against forced entry. The improved doorstop is useful both on sliding doors as well as hinged doors. Several alternative embodiments of the improved doorstop are shown and described. When used with a hinged wooden door, the doorstop optionally includes the use of a rigid plate which may be affixed to the door to protect the door from damage by the device and to distribute force exerted against the door over a larger surface area.

18 Claims, 10 Drawing Sheets

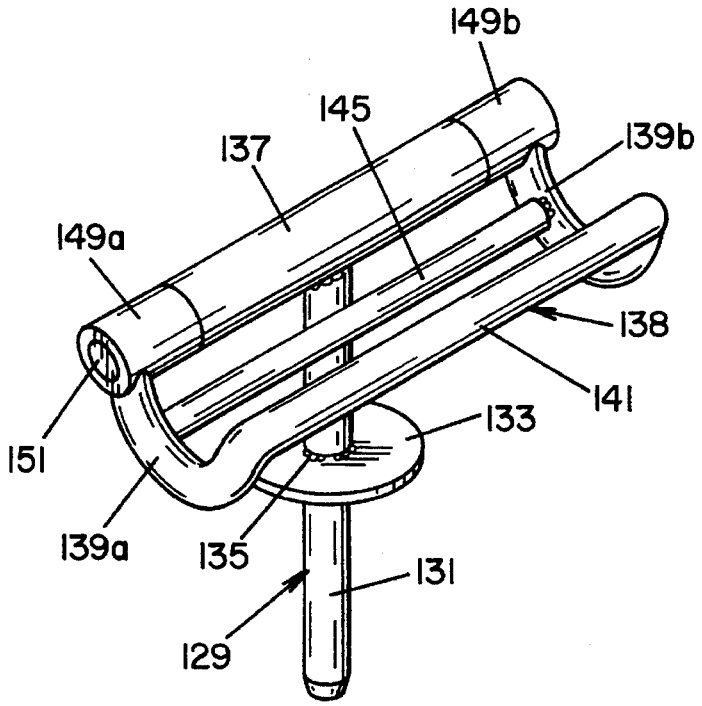
FIG. 9
FIG. 10
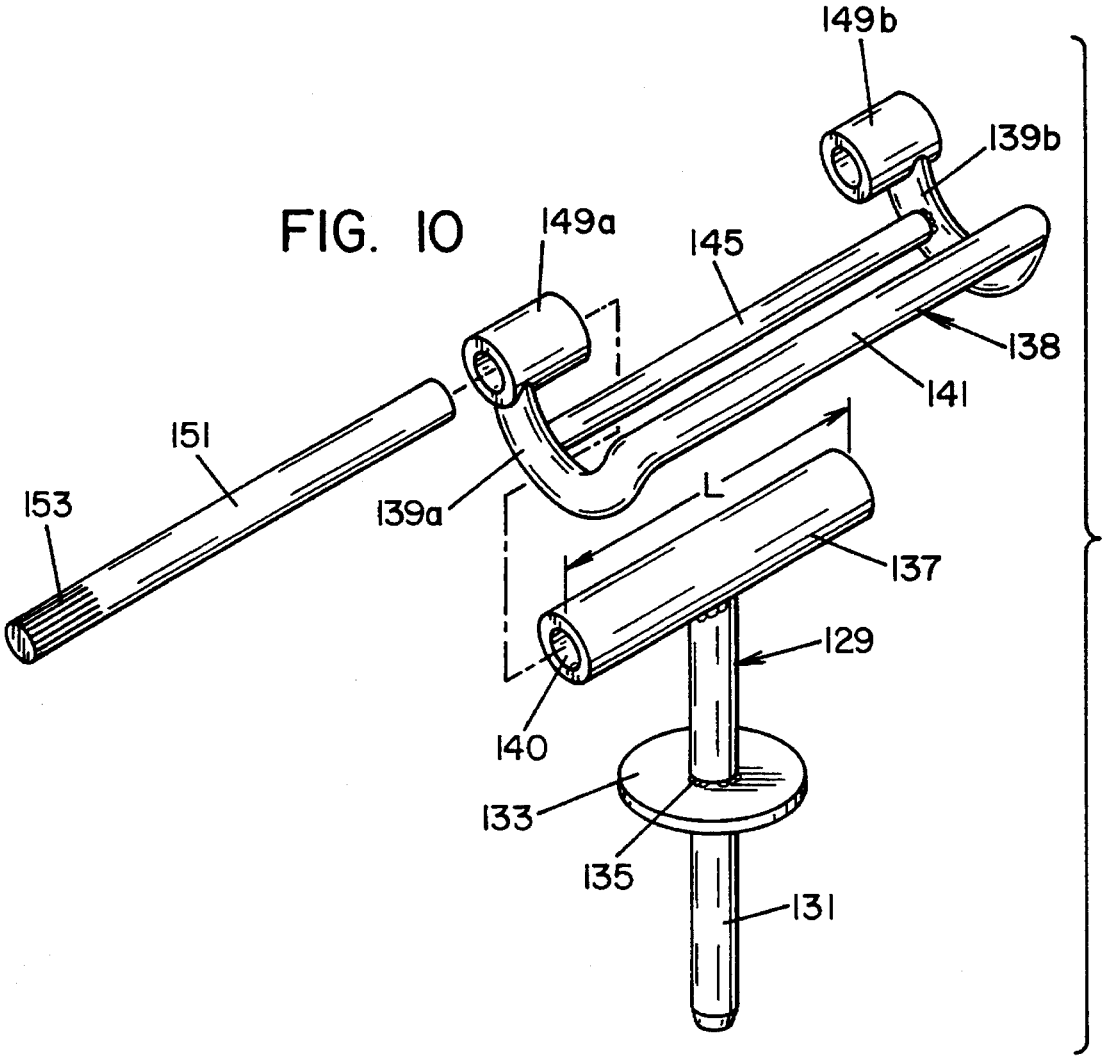

FLOOR MOUNTED DOORSTOP

FIELD OF THE INVENTION

The present invention relates to a doorstop of the type that selectively controls the movement of a hinged or sliding door. More particularly, the present invention relates to a doorstop that either prevents movement of a door when closed, or permits limited movement of the door to a predetermined distance from the closed position to prevent entry of a human body through the doorway. Even more particularly, the present invention relates to a floor mounted doorstop that selectively permits limited movement of a closed door without the necessity of removing the doorstop from its floor mounting.

BACKGROUND OF THE INVENTION

Apparatus for locking a door in a closed position are numerous and varied in design and complexity. The shortcoming of most locking apparatus is that they only operate to secure the door when the door is in the closed position. If the door should be opened to view objects on the other side or to pass small items through the doorway, most locking apparatus will not prevent the door from being forced completely open by an unwanted intruder.

Door chains connected to the door frame and selectively connected to the door provide a means for limiting the movement of a door from a closed position. However, most door chains are limited in the amount of force exerted on a door that the chain can withstand. The chain must be connected to the door itself, which provides a minimal structural base for securing the chain and further, the force exerted on the door by an intruder is concentrated at the connection of the chain with the door. Most chains are detachably engaged by brackets connected to the door by screws or other fasteners common to the industry. The force of an intruder is concentrated on the fasteners which usually have a minimal cross-sectional area and/or a minimal securing in contact with the door. Screws, bolts, nails and other securing apparatus tend to strip from the door when a large force ( i.e. the mass of a human body in motion) is exerted against the door. Even if the securing apparatus were to hold, it is likely that the concentration of force on such a small area of the door will break the portion of the door to which the chain is attached, thus permitting the door to open.

Another method of limiting the movement of the door from a closed position is the use of door braces which are pivotally secured at a lower end to the floor and extend in angular relation to and in abutment with the door. An upper end of the door brace is received within a vertically extending slot in the door such that movement of the door from the closed position will urge the upper end of the brace to the top of the slot whereby the brace will contact a stop and thus resist further movement of the door. The problem with door braces is twofold. One, the force exerted by an intruder is still concentrated at a very small area of the door and if the door is wooden, as many doors are, the door brace could be driven through the door. Secondly, the door brace assembly extends some distance from the door and within the adjacent room, thus presenting a visually distracting sight and possibly a hazardous obstacle to an inattentive person who may inadvertently trip over the brace.

A recent improvement in doorstops, commercially know as the "Door Club", is a floor mounted device which allows an occupant to prevent or limit the ability of a potential intruder to gain a forced entry through the door. This device comprises a shaft adapted to be slidably received in a tubular receptacle seated within a hole in the floor near the door. The shaft extends upwardly into the pathway of the door, effectively limiting movement of the door. Integral with the shaft are parallel horizontal cross members joined to one another at their ends by two semi-circular portions which are parallel to one another but which project horizontally at right angles to the parallel cross members. When the shaft is slid into the receptacle with the semi-circular portions extending towards the door, the semi-circular portions contact the closed door and prevent opening of the door. If the shaft of the "Door Club" is removed from the receptacle, is rotated 180 degrees about its axis and is reinserted into the receptacle, the semi-circular portions then face away from the door whereupon the door can be opened a small but finite distance until it contacts the shaft and/or the horizontal cross-members integral therewith, whereupon further movement of the door is arrested. During the brief interval when the "Door Club" has been removed from the receptacle to reverse it, the door is vulnerable to a sudden force which could open it.

A modification of the doorstop is adapted for use on sliding doors of the type typically used to join the interior of a building with an outside deck or patio. In this application, a plurality of holes are located along the door track, with the hole closest to the door when in a closed position adapted to coact with the doorstop to prevent any movement of the door when closed. The door may be opened progressively wider by removing the doorstop from the first hole and placing it in one of the other holes. Because many sliding doors are made of glass, the observer on the other side of the door can readily observe when the doorstop has been removed from one hole and can suddenly force the door open before the building occupant has an opportunity to place the doorstop in the second hole.

SUMMARY OF THE INVENTION

One object of the present invention is to provide a security device that can selectively prevent opening of a hinged or sliding door, but can be safely adjusted to permit the door to be partially opened a pre-determined yet safe distance from a closed position.

Another object of the present invention is to provide a doorstop that will substantially obstruct movement of a door from its closed position and that can be easily and safely repositioned to allow limited or restricted opening of the door.

Still another object is an adaption of the "Door Club" which enables the user to move it from a first position to a second position without temporarily sacrificing the safety features of the device.

These and other objects and advantages of the present invention are accomplished through the use of a security device adapted to be mounted on the floor in proximity to and on the inside of a hinged door, said device comprising (a) floor mounting means adapted to be accommodated in a recess within the floor; (b) door contact means moveable between a first position in contact with the door whereby movement of the door from a closed position is essentially precluded, and a second position whereby limited movement of the door is permitted, and (c) hinge means pivotally joining said floor mounting means with said door contact means. The floor mounting means typically includes a post adapted to be inserted into the floor recess. Said post may include a flange adapted to contact the floor to limit the distance that the post extends into the recess. In one embodiment, a sleeve is attached to the post at or near the top thereof and is held in place by brazing, welding, etc. The sleeve generally is orthogonal to the post, whereupon when the post is vertically positioned with-in the floor recess, the sleeve is in a substantially horizontal plane.

The portion of the device that is engaged by the sleeve includes a pair of parallel spaced apart arcuate members joined at one end by means adapted to engage the sleeve. In a further embodiment of the invention, the device includes a flanged receptacle adapted to be inserted into the floor recess. The receptacle can be secured to the floor using flat head recessed screws, a suitable adhesive, or by other fastening means, well known in the art.

In another embodiment of the invention, the door contact means is pivotally connected to the floor mounting means by engaging a semi-circular bead on the floor mounting means with a corresponding slot or groove in the door contact means.

As a further modification, a rigid plate may be connected to a hinged door in the area of the door in contact with this improved device, to distribute the contact load across a greater width of the door.

In rather broad fashion, the salient features of the invention have thus been outlined in order that the detailed description of the same may be better understood.

BRIEF DESCRIPTION OF THE DRAWINGS

The accompanying drawings depict a preferred embodiment of the invention, as well as various modifications thereof, all of which will be described in greater detail hereinafter.

FIG. 9 is a perspective view of a second embodiment of the present invention;

FIG. 10 is an exploded view in perspective of the embodiment of the invention shown in FIG. 9;

DETAILED DESCRIPTION OF THE INVENTION

Figure 1:
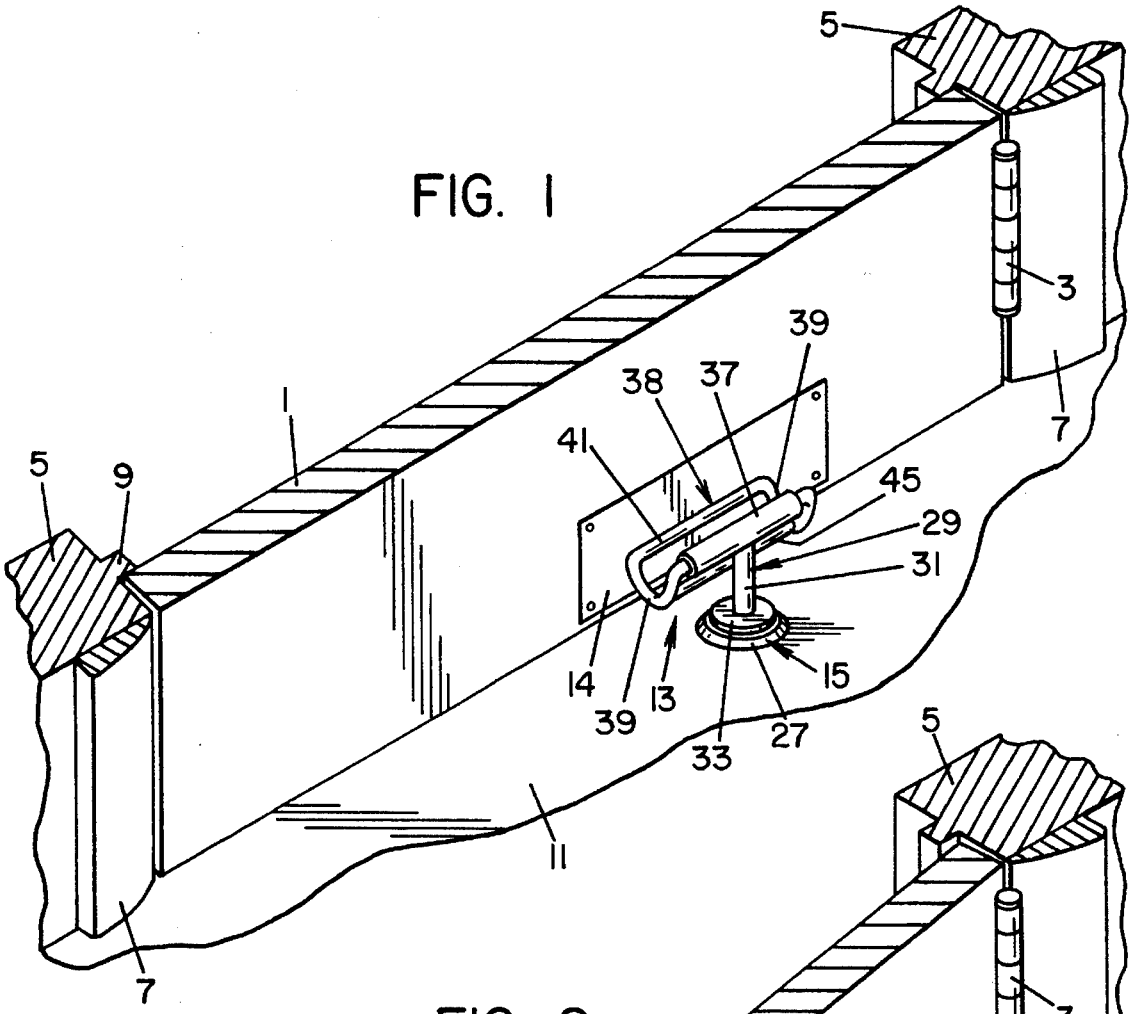
FIG. 1 and FIG. 2 are perspective views of the lower portion of a door in a closed position and partially open position, shown in connection with the doorstop of the present invention.
Figure 2:
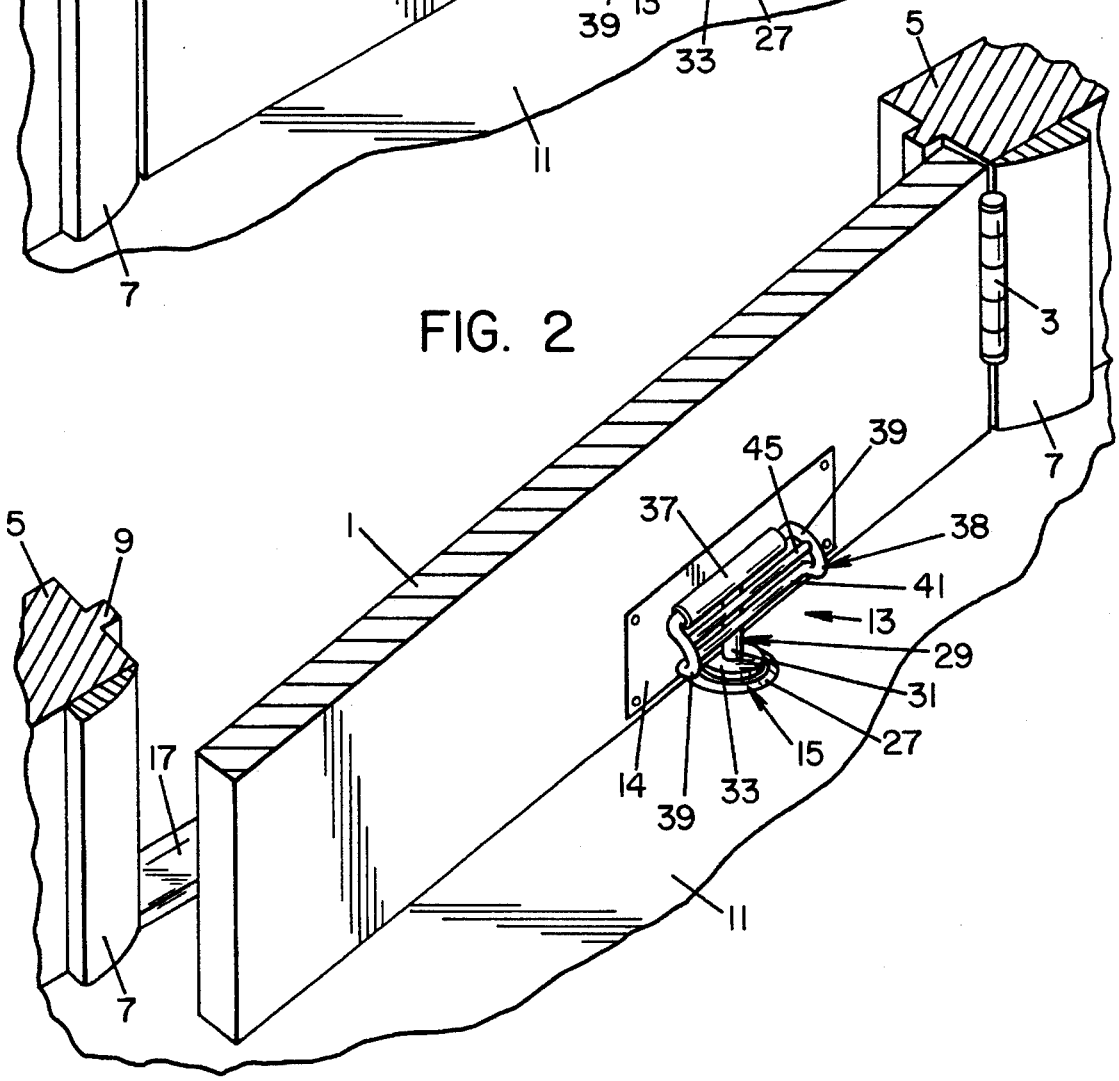
Figure 3:
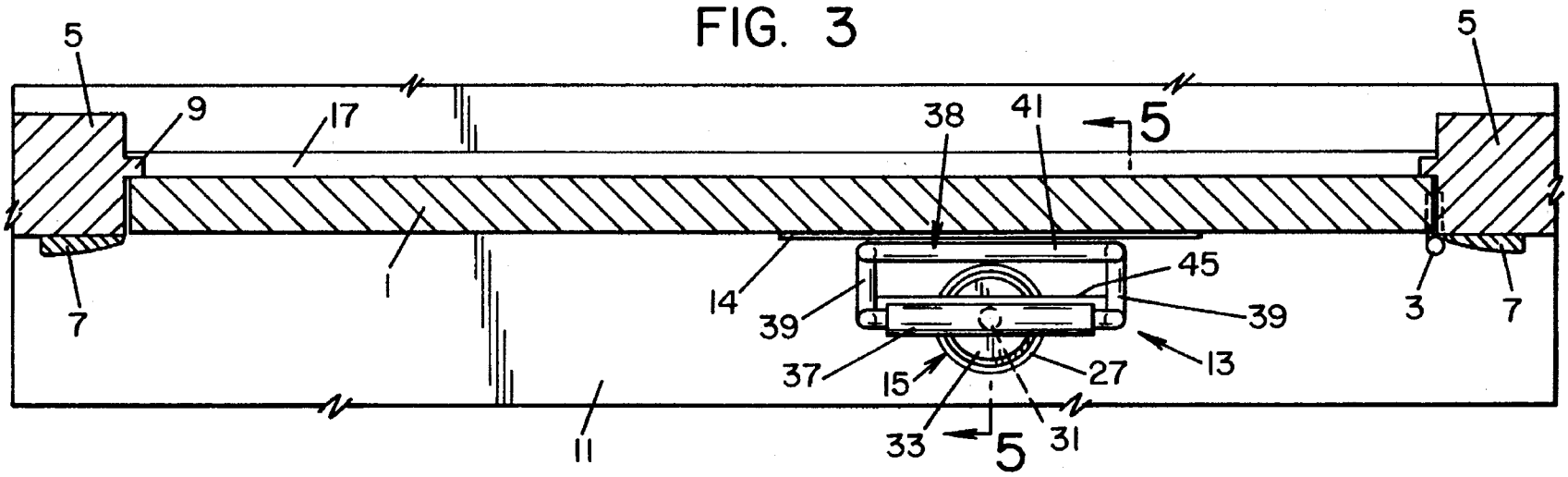
FIGS. 3 and 4 are top views of FIGS. 1 and 2 respectively.
Figure 4:
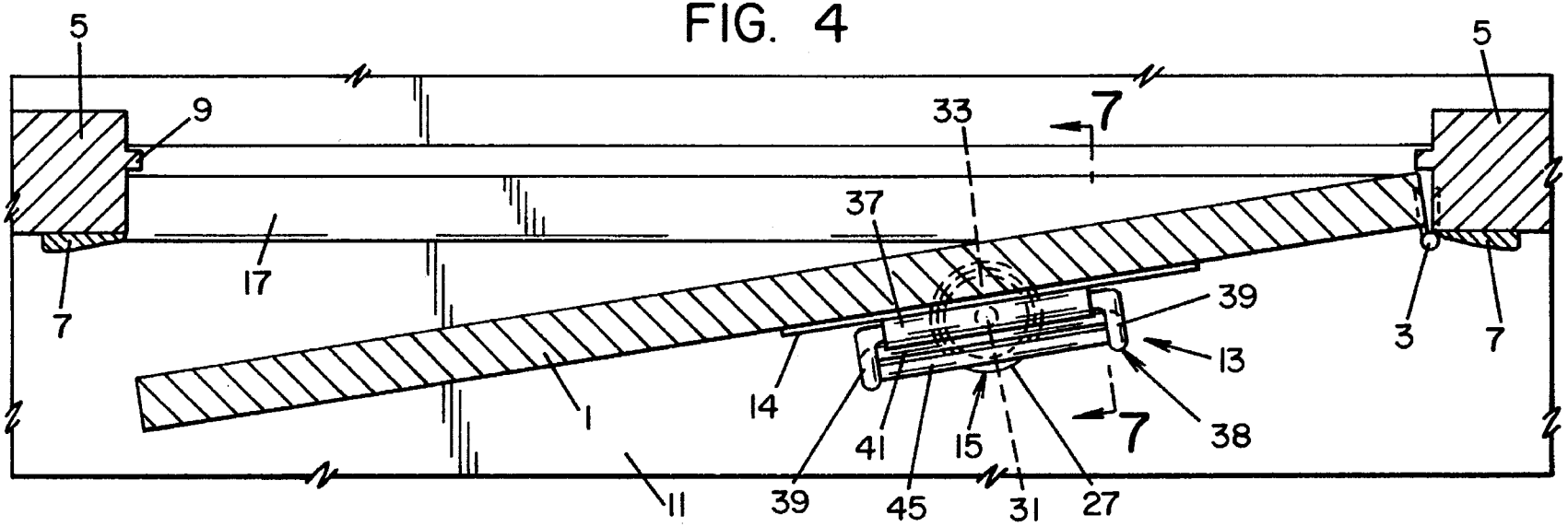

Referring now to the drawings for a clearer understanding of the invention, FIG. 1 shows a simplified arrangement of a hinged door 1 joined by hinges 3 to a door jamb 5. A suitable decorative molding 7 surrounds the framework of the door. The door in FIG. 1 is shown in the closed position abutting doorcheck 9. Mounted on the floor 11 on the inside of the door is a doorstop 13 of the present invention. The doorstop 13 is adapted to be received into a receptacle 15 similar to that used for the original "Door Club" . Details of the doorstop and receptacle will be shown hereinafter in greater detail in FIGS. 5–8. As will readily be noted, FIGS. 1 and 3 show the door in a totally closed position, with the doorstop in contact with rigid plate 14. FIGS. 2 and 4 show the door partially opened, with the doorstop 13 in the alternative, second position.

The doorstop comprises base member 29 having a post 31, the lower portion of which is received in the receptacle 15, with post flange 33 resting thereon. Sleeve 37 joined to the post 31 receives the door contact member 38.

Figure 5:
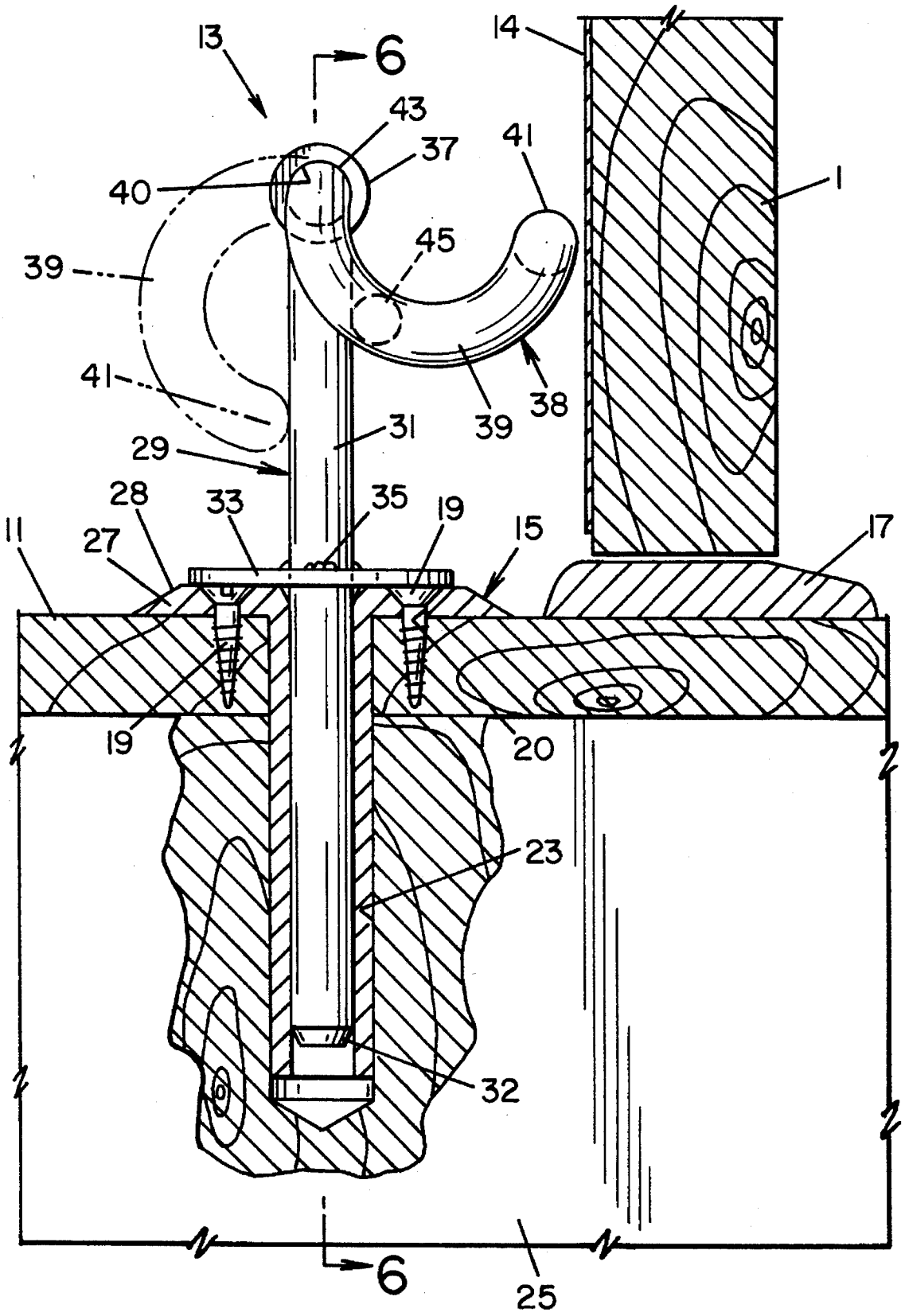
FIG. 5 is a view taken along lines 5—5 of FIG. 3.
Figure 6:
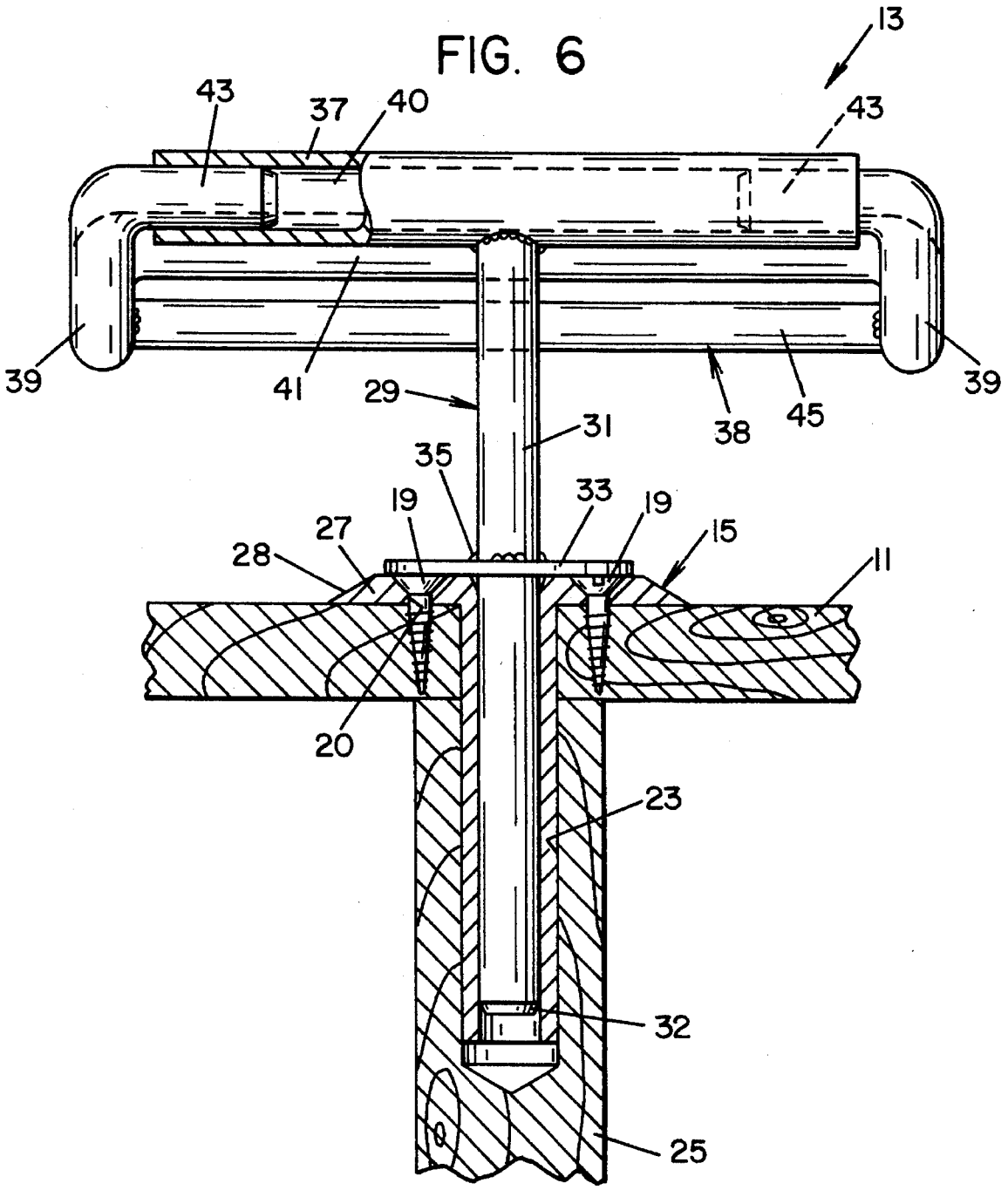
FIG. 6 is a cross-sectional view taken along lines 6—6 of FIG.5.
Figure 7:
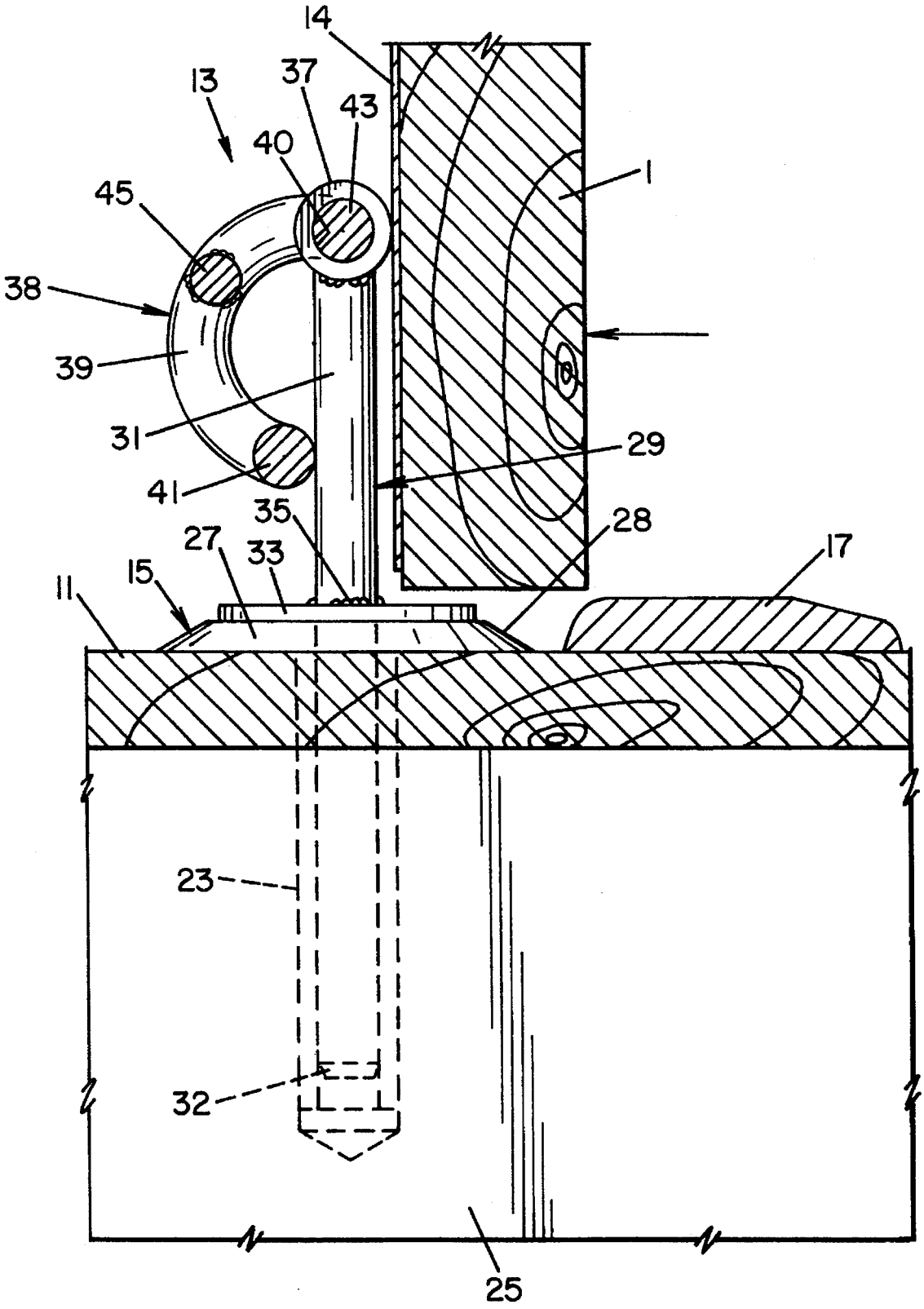
FIG. 7 is a cross-sectional view taken along line 7—7 of FIG. 4.

Referring now to FIGS. 5–8, the doorstop of the present invention is pictured in FIG. 5 with the door in a completely closed position and in FIG. 7 with the door partially open. As noted in FIG.5, the door 1 is spaced above the door threshold 17 which in turn is secured to the floor 11. Also secured to the floor by suitable means such as flathead screws 19 is a flanged receptacle 15 seated in hole 23, drilled into or otherwise provided in floor joist 25. The top of the receptacle 15 comprises a flange 27, preferably provided with a beveled edge 28 to minimize trip hazards and being sufficiently thin to provide clearance with the bottom of the door when opened. Inserted into the receptacle 15 is a post 31, shown with a separate flange 33 secured thereto by tack welds 35. Mounted at the top of the post is a sleeve 37. Pivotally joined to the sleeve is a door contact means 38. This contact means includes a pair of arcuate, parallel sections 39 joined together at one end by an elongated door contact surface 41, shown as a rod. The other end of the arcuate sections terminate in inserts 43 pivotally engaging and extending into the ends of said sleeve 37. Spanning the arcuate sections is a rod 45 which contacts post 31 to arrest movement of the door contact means 38 when the door is closed. It will be noted that the elongated door contacting surface (shown more clearly in FIGS. 6 and 8) is below the pivot axis of the inserts 43 when the door is closed whereupon any pressure exerted against the closed door will force the movement arrester 45 against the post 31 and will prevent the door from opening.

FIG. 6 shows, in partial cross-section, a frontal view of the novel doorstep of the present invention as it would appear in contact with a closed door. This view shows more clearly the sleeve 37 brazed or otherwise secured to the top of post 31. The two arcuate end portions 39 are shown terminating with two axially aligned end members 43 engaging and pivotally mounted within bore 40 of the sleeve 37. The movement arrester 45 is seen in contact with post 31.

As shown in FIG. 7, door contact surface 41, has been pivoted away from the door to permit the door to be opened until it contacts the post 31 or the sleeve 37, if the sleeve has a greater diameter than the post. The door contact means 38 when pivoted out of the way to permit limited opening of door 1 is stopped when the elongated door contact surface 41 contacts post 31.

Figure 8:
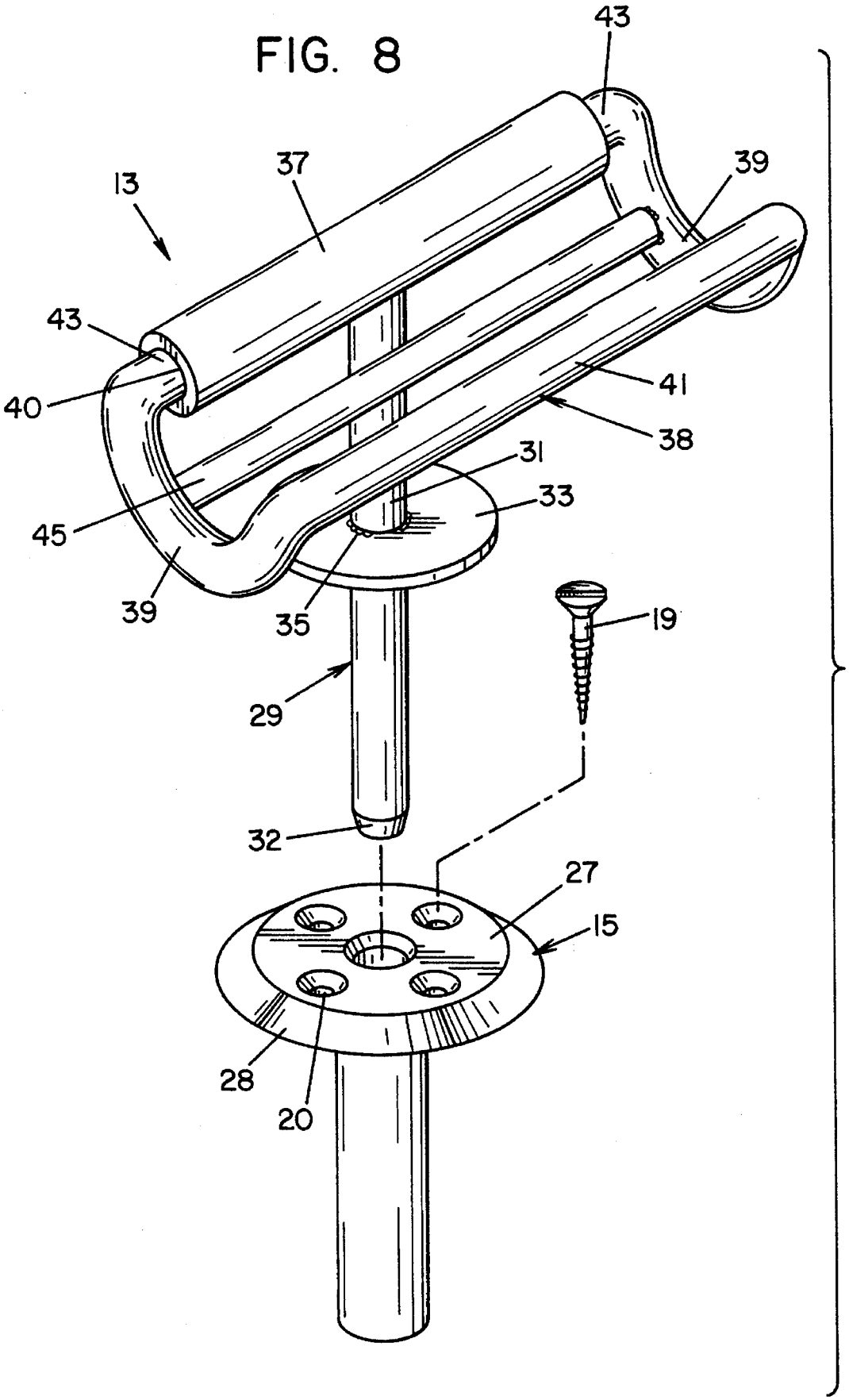
FIG. 8 is an exploded perspective view of one embodiment of the doorstop device of the present invention.

FIG. 8 shows, in exploded view, the various details as has been previously described and explained with reference to the FIGS. 1–7. In this figure, the receptacle 15 is clearly shown with beveled flange 27 and a plurality of screw holes 20 counter sunk so as to receive the flat head screws 19. The lower end of the post is preferably provided with a slight bevel 32 to permit easy insertion into the receptacle 15. As previously mentioned, flange 33 on said post in connection with flange 27 serves to position the door stop in the proper location with respect to the bottom of the door, obviously this post flange 33 can be attached to the doorstop by means other than tack welding or brazing. For example, a set screw or other means (not shown) can be used to permit adjustment of the flange 33 up or down on the post 31.

The post and the hole in the receptacle are round to permit the post to be rotated about its vertical axis. However, it should be understood that the post could be hexagonal, or have other cross sections, compatible with similar cross sections of the hole within the receptacle 15. When using a different cross sectional shape, the insert is preferably positioned within the receptacle so that the elongated door contact surface is generally parallel with the planar surface of the door.

A rigid metal plate such as a brass kick plate 14 may be connected to the door 1 such that movement of the door from a closed position will urge the rigid plate into contact with the elongated door contact surface 41 or the post 31. The rigid plate protects the door from being damaged by contact with the contact surface 41 and post 31 and distributes the force exerted by a potential intruder over the enlarged surface area of the plate 14.

If the floor 11 is constructed of concrete, steel or other more rigid material, the receptacle 15 may be eliminated and the post 31 inserted directly within the floor recess 23 with flange 33 resting on the floor 11. Even when the floor is constructed of a rigid material such as concrete, however, the use of a receptacle will prevent the post from wearing the interior of the recess and thus prevent unnecessary movement of the post from its normal vertical position. The receptacle should be spaced from the door jamb, such that the door cannot be opened sufficiently to permit a person to squeeze through, and should be located close enough to the door hinge to prevent an intruder from reaching around the door to dislodge the doorstop.

When not in use, the doorstop 13 may be suspended from a hook or other securing apparatus (not shown) conveniently connected to the door or to the wall beside the door.

An alternative means of joining the door contact member to the base member is shown in FIGS. 9 and 10. The base member 129 is similar in design to that shown in FIG. 8, and comprises an elongated sleeve 137 joined at right angles to a post 131 by suitable means, said post having a flange 133 welded thereto with tack welds 135 to permit positioning of the post with respect to the floor mounted receptacle (not shown). The door contact means 138 comprises an elongated door contact surface 141, the ends of which are integral with arcuate members **139*a* and 139*b*. Instead of utilizing end members adapted to be inserted into the ends of the sleeve, as shown in the prior embodiment, short bushings 149*a*, 149*b* are joined to the arcuate members 139*a* and 139*b* respectively by welding or the like and are positioned to be in axial alignment with one another. These bushings 149*a*, 149*b* are spaced apart a slightly greater distance than the length L of sleeve 137. The sleeve is secured to the bushings by hinge pin 151. At one end of the pin are grooves 153, used in typical fashion to create a tight fit in bushing 149*a* when pressed into place during assembly of the device. Other means known in the art can be used to secure the hinge pin in place. The internal diameter 140 of the sleeve 137 is slightly larger than that of the bushings to permit relative pivotal movement of the door contact means 138 with respect to the base member 129. This embodiment operates in the same manner as the embodiment shown in the prior figures, utilizing a movement arrester 145 joined to arcuate members 139*a* and 139*b* and adapted, when maintaining a door in a closed position, to rest against posts 131. As in the prior embodiment, by pivotally moving the door contact means about the hinge pin to the position shown in FIG. 7**, limited but controlled movement of the door is thereby permitted.

Figure 11:
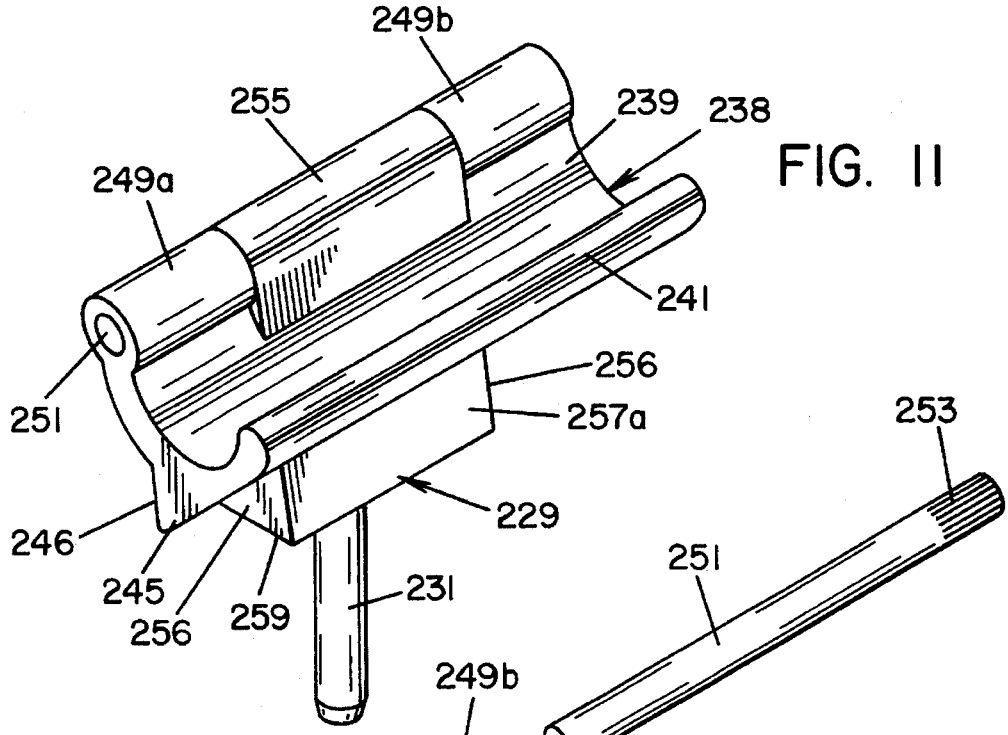
FIG. 11 is a perspective view of another embodiment of the present invention.
Figure 12:
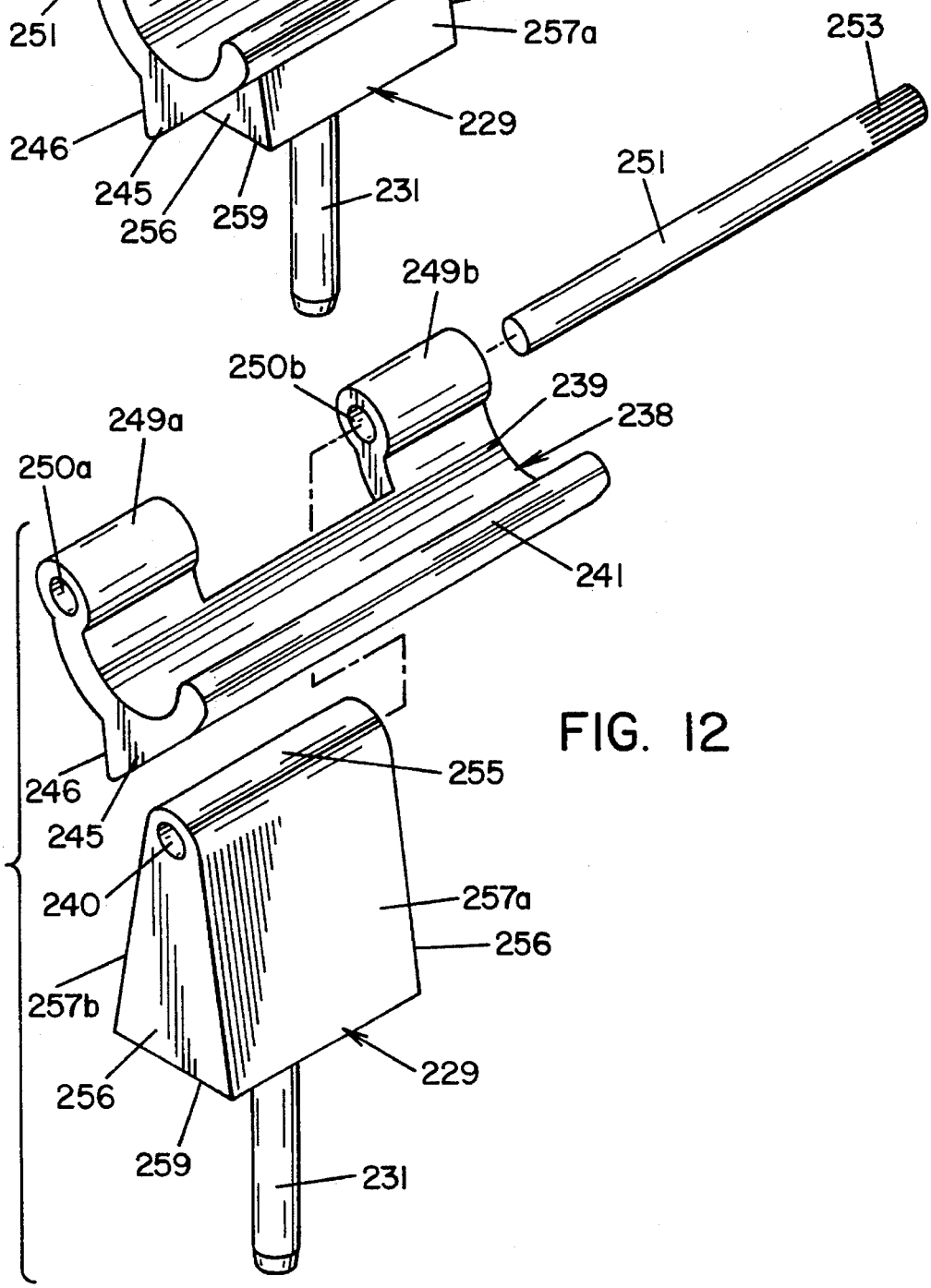
FIG. 12 is an exploded view in perspective of the embodiment shown in FIG. 11.
Figure 13:
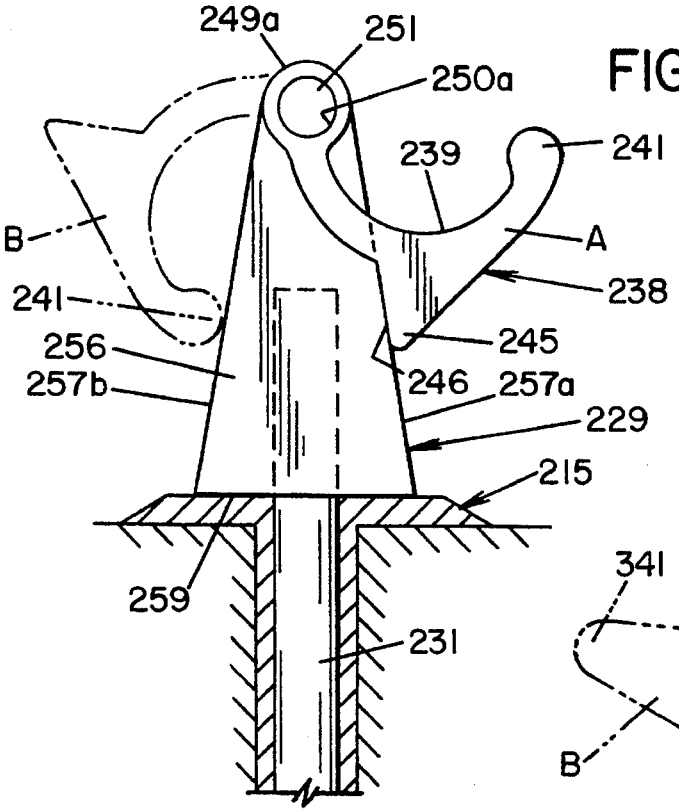
FIG. 13 is an elevational view of the embodiment of FIG. 11 installed in a floor receptacle.

FIGS. 11, 12 and 13 show another embodiment of the doorstop, also comprising a door contact means 238 joined by a hinge pin 251 to a base member 229. The base member includes a post 231 adapted to be inserted into a floor receptacle 215, and a base having the shape of a triangular prism having two parallel ends 256 and a cross-section of an isosceles triangle. The triangle comprises two generally equal sides **257*a*, 257*b* joined together by a shorter side 259, said shorter side comprising the lower planar portion of said base member serving to limit the movement of the post into the floor receptacle when the device is operational. The two generally equal sides 257*a*, 257*b* converge to form a curved surface 255. A hole 240 connecting the two parallel ends 256 of the prism extends through the base member parallel to and in proximity to the convergence. The door contact means 238 comprises an arcuate section 239 terminating in a door contact surface 241 and a pair of integral annular bushings or knuckles 249*a*, 249*b*. The arcuate section contains a motion arrester 245 having shoulder 246. As with the embodiments shown in FIGS. 9 and 10, the door contact means is pivotally connected to the base member 229 by aligning bushing holes 250*a*, 250*b* with the hole 240 in base member 229, and joining them together with hinge pin 251 containing grooves 253 to ensure a firm fit with bushing 249*b*. FIG. 13 shows the relationship of the door contact member 238 and base member 229 when the door is in a closed position A. Shoulder 246 rests against surface 257*a* of the base member when the door is closed, thereby preventing movement of the door. However, when the door contact member is swung up and around to position B as shown in outline in FIG. 13, the door is then permitted to move until it contacts the surface 257*a* of base member 229**.

Figure 14:
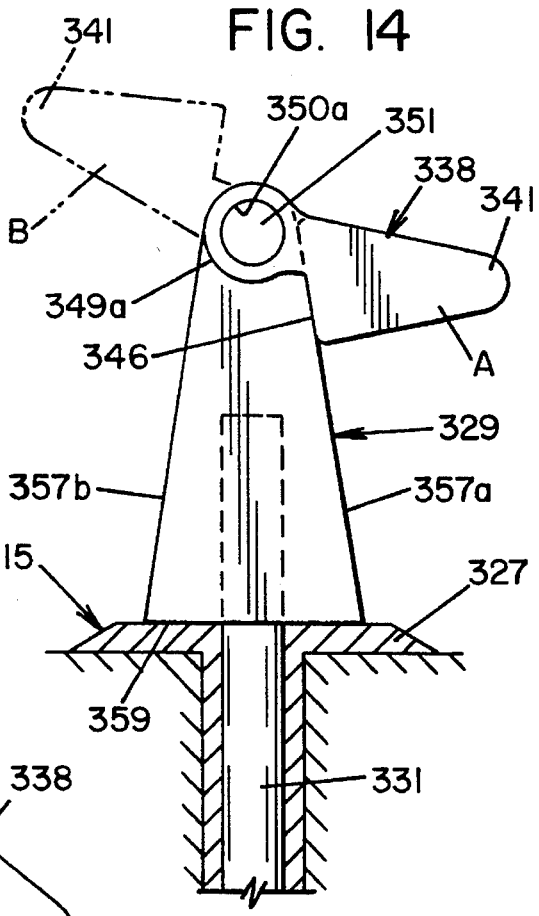
FIG. 14 is still another embodiment of the invention shown in elevation, installed in a floor receptacle.
Figure 15:
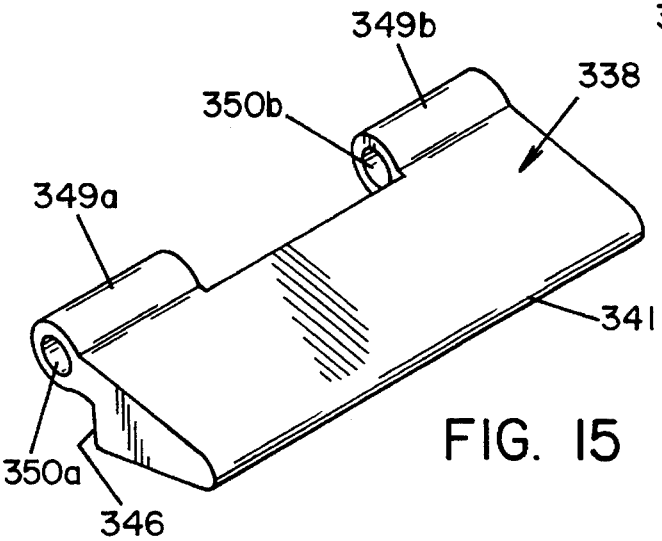
FIG. 15 is a perspective view of the door contact means used in the embodiment shown in FIG. 14.

FIGS. 14 and 15 show a variation of the door contact means adaptable for use with a base member similar to the one used in the previous embodiment shown in FIGS. 11–13. As can be seen in the perspective view of FIG. 15, the door contact member 338 is similar to one element of a door hinge, but with a generally triangular cross-section, with an elongated door contact surface 341 and a motion arrester defined by shoulder 346. A pair of integral bushings **349*a*, 349*b* contain axially aligned holes 350*a*, 350*b* which receive hinge pin 351 to pivotally join the contact member 338 to base 329. As seen in FIG. 14, when the door contact member 338 is in position A with the door closed, shoulder 346 abuts the surface 357*a* of the base member 329. As before, the base member includes a post 331 adapted to be received in a flanged receptacle 315, with the bottom part 359 of the base member 329 resting on the flange 327. The alterative position B of the door contact member 338, when out of contact with the door is shown in shadow outline. This embodiment is assembled in the same manner as the prior embodiment shown in FIGS. 9–13**.

Figure 16:
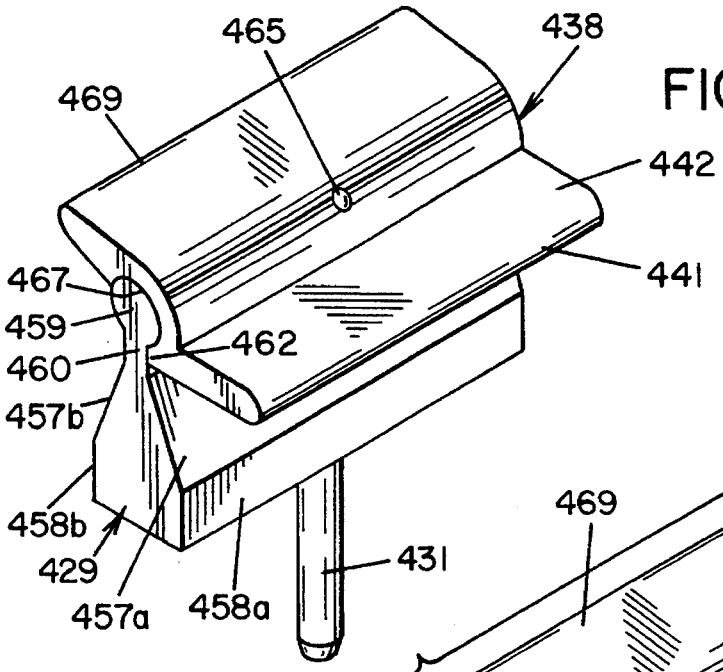
FIG. 16 is a perspective view of yet another embodiment of the present invention.
Figure 17:
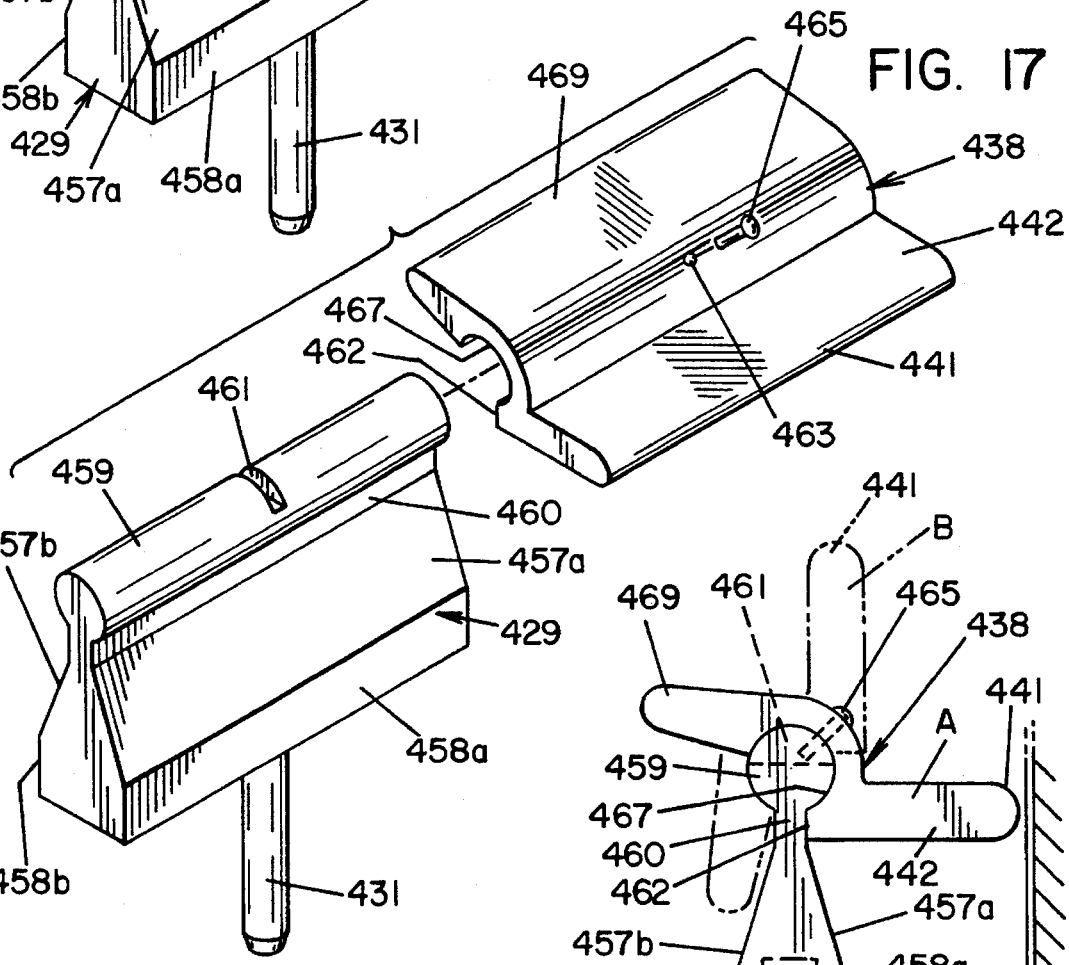
FIG. 17 is an exploded perspective view of the embodiment shown in FIG. 16.
Figure 18:
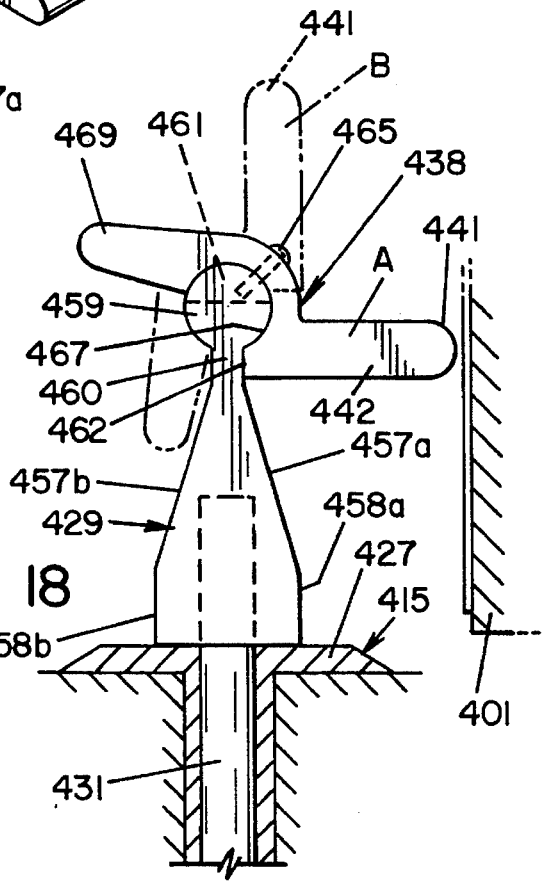
FIG. 18 is an elevational view of the embodiment of FIG. 17, installed in a floor receptacle, showing alternative positions for the door contact means.

FIGS. 16–18 show yet another modification of the present invention wherein the door contact member 438 is pivotally mounted to the base member without the use of a separate hinge pin. In this embodiment, the base member comprises a pair of parallel sides 458*a*, 458*b* joined to a pair of converging sides 457*a*, 457*b* terminating in neck 460 joining a semi-circular bead 459. As in the prior illustrations, FIGS. 9–15, the base member is secured to a post 431 adapted to be inserted in a floor receptacle 415 containing flange 427. The door contact member 438 contains an elongated groove or slot 467 adapted to mate with bead 459. The member 438 includes a door contact arm 442, with door contact surface 441 and lever 469. Pivotal movement of door contact member 438 is limited in position 'A' by contact of shoulder 462 with neck 460 and in position 'B' by contact of lever 469 with the side 457*b* of base 429.

The device of this embodiment is assembled by sliding the semi-circular bead. 459 into the slot 467 until hole 463 aligns with slot 461 in the base member 429. Pin 465 is pressed into the hole 463 until the end of the pin projects into slot 461 thereby preventing relative axial movement between the base and contact member. When the door contact member is in position 'A' shown in solid lines in FIG. 18, the door is prohibited from moving. However by pushing the lever 469 down, the door control means flips up to position 'B' (as shown in outline) to permit restrictive limited opening of the door 401. Opening movement of the door 401 is limited by contact with the underside of the door contact 442 as well as the surface 458*a* of the base member 429. Although this embodiment is shown with the bead on the base member and the slot in the door contact means, the device could function in the same manner with these two elements reversed, i.e. the slot in the base member and the semi-circular bead in the door contact means.

Although the invention has been described with respect to certain specific embodiments, the invention is not limited thereby. Instead, the invention is limited by the claims appended hereto as well as all equivalents thereof.

What is claimed is:

1. An improved doorstop useful with a door to keep the door closed or alternatively to allow the door to be partially opened, said doorstop comprising:

a) a floor mounted receptacle adapted to be positioned in proximity to the closed door, b) a removable base member received in said receptacle, c) door contact means comprising a pair of parallel, spaced apart, arcuate members joined at one end by means cooperating with the arcuate members to form an elongated door contact surface and at other end by means pivotally engaging said base member, said door contact means pivotally movable from a first position in abutting contact with said door when closed to a second position allowing the door to be partially opened without removing said door contact means from said base member, and d) movement arresting means defining the location of said door contact means when in the first position.

2. The doorstop according to claim 1 wherein said movement arresting means is positioned relative to said door contact means whereby the rotation of said contact means when subjected to a force such as that exerted by an attempt to open the door is resisted by said arresting means.

3. The doorstop of claim 2 wherein the axis of rotation of said contact means is generally horizontal when said base member is positioned in said receptacle, and the point at which said door contact means contacts said door in the closed position is below said axis.

4. The doorstop according to claim 3 wherein said movement arresting means is joined to said spaced arcuate members intermediate their ends.

5. The device of claim 1 wherein said floor mounted receptacle includes a flange adapted to rest on the floor to position said receptacle when placed in a recess in the floor and said base member includes means contacting said flange to position the base member within the receptacle.

6. A device adapted to be mounted on the floor in proximity to a door, said device comprising a) a base member including a post adapted to be inserted into a recess in the floor;

b) door contact means; and c) hinge means for pivotally joining said door contact means to said post, permitting pivotal movement of said door contact means between a first position in contact with the door whereby opening of the closed door is essentially precluded, and a second position permitting limited but secure opening of the door, said hinge means including a sleeve joined to the top of said post generally at right angles thereto.

7. The device according to claim 6 further including a movement arresting means associated with said door contact means and said base member to define said first position of said door contact means.

8. The device according to claim 7 wherein said door contact means includes a pair of parallel spaced apart arcuate members joined at one end by means forming an elongated door contact surface and at the other end by sleeve engaging means.

9. The device according to claim 8 wherein said sleeve engaging means comprises a pair of axially aligned bushings spaced apart from one another to accommodate said sleeve whereupon said door contact means pivotally moves with respect to said base member.

10. The device according to claim 8 wherein said sleeve engaging means comprise two axially aligned end portions extending toward one another, inserted into the respective ends of said sleeve and rotatable with respect thereto.

11. The device according to claim 6 wherein said base member includes a lower planar portion to limit the extent to which said post can be inserted into the floor recess.

12. A floor mounted safety device adapted to be inserted into a recess in the floor in proximity to a door, said device including a) a base member comprising a post for engaging the recess, a generally triangular prism comprising two parallel ends and a triangular shape conforming generally to an isosceles triangle, creating two generally equal converging faces, and a third face comprising the lower portion of said member joined to said post to limit the extent to which said post is insertable into said recess;

b) door contact means, and c) hinge means for pivotally joining said door contact means to said triangular prism, permitting movement of said door contact means between a first position adapted to contact the door whereby opening of the door when closed is essentially precluded, and a second position whereby limited but secure opening of the door is permitted.

13. The device according to claim 12 wherein said base member contains an annular hole extending therethrough joining the two parallel ends of said prism, parallel with and in proximity to the convergence of said two equal faces.

14. The device according to claim 13 wherein said door contact means includes a pair of axially aligned, spaced apart annular bushings pivotally joined to said base member by a hinge pin passing through said annular bushings and said annular hole in said base member.

15. The device according to claim 14 wherein said door contact means includes an elongated door contact surface and a shoulder remote from said door contact surface in abutting relationship with said door base member when said door contact surface is in the first position.

16. A device adapted to be mounted in a floor recess in proximity to a door, said device comprising a base member including a post to insertably engage the recess, and a planar portion serving to limit the distance that the post is insertable into the recess, a door contact means, and hinge means for pivotally joining said door contact means to said base member, said hinge means comprising an elongated semi-circular bead, and an elongated semi-circular groove to receive the semi-circular bead to permit said hinge means to pivot between a first position in contact with the door when said door is closed and a second position whereby limited but secure opening of the door is permitted.

17. The device according to claim 16 wherein the base member includes the bead and the contact means includes the slot.

18. The device according to claim 16 wherein said bead contains a radially extending slot and said groove includes a projection engaging said slot thereby preventing relative lateral movement between said contact means and said bead.

* * * * *